US006449900B1

(12) United States Patent
Weder

(10) Patent No.: US 6,449,900 B1
(45) **Date of Patent: *Sep. 17, 2002**

(54) PLANT WRAPPER

(75) Inventor: Donald E. Weder, Highland, IL (US)

(73) Assignee: Southpac Trust International, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 09/910,084

(22) Filed: Jul. 20, 2001

Related U.S. Application Data

(63) Continuation of application No. 09/465,613, filed on Dec. 17, 1999, now Pat. No. 6,321,486.

(51) Int. Cl.[7] ..... A01G 9/02
(52) U.S. Cl. ..... 47/72
(58) Field of Search ..... 47/72

(56) References Cited

U.S. PATENT DOCUMENTS

| | | | | |
|---|---|---|---|---|
| 84,207 | A | 11/1868 | Moore | 229/4.5 |
| 239,987 | A | 4/1881 | Shallenberger | |
| 580,671 | A | 4/1897 | Perry | 229/4.5 |
| 681,066 | A | 8/1901 | Millinger | |
| 716,668 | A | 12/1902 | Cheney | |
| 732,889 | A | 7/1903 | Paver | |

(List continued on next page.)

FOREIGN PATENT DOCUMENTS

| | | |
|---|---|---|
| AT | 192843 | 11/1957 |
| AU | 4231978 | 6/1979 |
| BE | 654427 | 1/1965 |
| CH | 161005 | 3/1941 |
| CH | 560532 | 4/1975 |
| CH | 274167 | 10/1983 |

(List continued on next page.)

OTHER PUBLICATIONS

Speed Cover Brochure, "The Simple Solution For Those Peak Volume Periods", Highland Supply Corporation, ©1989.
"Speed Sheets and Speed Rolls" Brochure, Highland Supply Corporation, ©1990.
"Color Them Happy with Highlander Products" ©1992.
"Costa Keeps the Christmas Spirit", Supermarket Floral, Sep. 15, 1992.
"Super Seller", Supermarket Floral, Sep. 15, 1992.
"Halloween", Link Magazine, Sep. 1992, 2 pages.
"Now More Than Ever", Supermarket Floral, Sep. 15, 1992.
Le Plant Sac Advertisement, published prior to Sep. 26, 1987.
"A World of Cut Flower and Pot Plant Packaging" Brochure, Klerk's Plastic Products Manufacturing, Inc., published prior to Mar. 31, 1994, 6 pages.
Chantler & Chantler brochure showing Zipper Sleeve™and Florasheet®, published prior to Mar. 31, 1994, 2 pages.
"Foil Jackets" brochure, Custom Medallion, Inc., Dec. 1996, 2 pages.
"Derwent Abstract" of FR 2610604A. It is noted that the abstract is an incorrect English translation of the contents of the French patent. The French patent does not enable or disclose adhesively attaching the covering to the container. 1988.
"Silver Linings" Brochure, Affinity Diversified Industries, Inc., 1986. The Silver Linings brochure shows a floral sleeve with a closed bottom. The brochure shows, in one embodiment, a vase with flowers inside a "cut flower" sleeve with the sleeve tied with a ribbon about the neck of the vase.

*Primary Examiner*—Charles T. Jordan
*Assistant Examiner*—Francis T. Palo
(74) *Attorney, Agent, or Firm*—Dunlap, Codding & Rogers, P.C.

(57) ABSTRACT

A wrapper for flower pots. The wrapper is a segmented sheet with each segment having a lower portion sized to surround a pot and an upper portion detachable from the lower portion via a detaching element such as perforations. The sheet can be formed about a pot and the adjacent edges of the segment joined and sealed.

32 Claims, 2 Drawing Sheets

U.S. PATENT DOCUMENTS

| | | | | |
|---|---|---|---|---|
| 797,175 | A | 8/1905 | Collenberg | 47/72 |
| 923,663 | A | 6/1909 | Kroeger | |
| 1,002,346 | A | 9/1911 | Weeks | |
| 1,052,379 | A | 2/1913 | Ranken | |
| 1,064,813 | A | 6/1913 | Bloomberg | |
| 1,069,675 | A | 8/1913 | Claussen | |
| 1,206,708 | A | 11/1916 | Hutchins | |
| 1,293,316 | A | 4/1919 | Bogert | 229/4.5 |
| 1,421,027 | A | 6/1922 | Reynolds | |
| 1,421,628 | A | 7/1922 | Watkins | |
| 1,446,014 | A | 2/1923 | Lodge | 47/72 |
| 1,446,563 | A | 2/1923 | Hughes | |
| 1,520,647 | A | 12/1924 | Hennegan | |
| 1,610,652 | A | 12/1926 | Bouchard | |
| 1,693,435 | A | 11/1928 | Clarke | 206/45.31 |
| 1,697,751 | A | 1/1929 | Blake | 229/87 |
| 1,863,216 | A | 6/1932 | Wordingham | |
| 1,868,853 | A | 7/1932 | Sievers | |
| 1,920,533 | A | 8/1933 | Strauss | 281/34 |
| 1,924,926 | A | 8/1933 | Gray | 65/53 |
| 1,951,642 | A | 3/1934 | Augustin et al. | 47/66 |
| 1,978,631 | A | 10/1934 | Herrlinger | 91/68 |
| 1,979,771 | A | 11/1934 | Potter | 47/41 |
| 2,076,212 | A | 4/1937 | Suter et al. | 91/67.9 |
| 2,123,075 | A | 7/1938 | Langa | 47/34 |
| 2,152,648 | A | 4/1939 | Jones | 47/34 |
| 2,165,539 | A | 7/1939 | Dahlgren | 206/80 |
| 2,200,111 | A | 5/1940 | Bensel | 229/1.5 |
| 2,209,778 | A | 7/1940 | Krasowski | 41/10 |
| 2,278,673 | A | 4/1942 | Savada et al. | 154/43 |
| 2,302,259 | A | 11/1942 | Rothfuss | 41/10 |
| 2,317,554 | A | 4/1943 | Risch | 206/45.31 |
| 2,323,287 | A | 7/1943 | Amberg | 229/53 |
| 2,355,559 | A | 8/1944 | Renner | 229/8 |
| 2,371,985 | A | 3/1945 | Freiberg | 206/46 |
| 2,373,634 | A | 4/1945 | Wagner | 117/122 |
| 2,411,328 | A | 11/1946 | MacNab | 33/12 |
| 2,482,981 | A | 9/1949 | Kamrass | 41/13 |
| 2,510,120 | A | 6/1950 | Leander | 117/122 |
| 2,529,060 | A | 11/1950 | Trillich | 117/68.5 |
| 2,578,583 | A | 12/1951 | O'Brien | 206/65 |
| 2,612,989 | A | 10/1952 | Harrison | 206/45 |
| 2,664,670 | A | 1/1954 | Mulford | 47/37 |
| 2,688,354 | A | 9/1954 | Berger | 150/28 |
| 2,707,352 | A | 5/1955 | Fischer | 47/58 |
| 2,744,624 | A | 5/1956 | Hoogstoel et al. | 206/65 |
| 2,774,187 | A | 12/1956 | Smithers | 47/41 |
| 2,822,287 | A | 2/1958 | Avery | 117/14 |
| 2,827,217 | A | 3/1958 | Clement | 229/1.5 |
| 2,845,735 | A | 8/1958 | Werner | 41/10 |
| 2,871,080 | A | 1/1959 | Shelly | 312/107 |
| 2,925,208 | A | 2/1960 | Wood | 229/4.5 |
| 2,942,823 | A | 6/1960 | Chapman | 248/97 |
| 2,967,652 | A | 1/1961 | Canfield et al. | 229/5.5 |
| 2,989,828 | A | 6/1961 | Warp | 53/390 |
| 3,013,689 | A | 12/1961 | Shropshire | 215/100.5 |
| 3,022,605 | A | 2/1962 | Reynolds | 47/58 |
| 3,080,680 | A | 3/1963 | Reynolds | 47/37 |
| 3,094,810 | A | 6/1963 | Kalpin | 47/37 |
| 3,113,673 | A | 12/1963 | Stein | 206/65 |
| 3,130,113 | A | 4/1964 | Silman | 161/97 |
| 3,271,922 | A | 9/1966 | Wallerstein et al. | 53/3 |
| 3,322,325 | A | 5/1967 | Bush | 229/62 |
| 3,376,666 | A | 4/1968 | Leonard | 47/41 |
| 3,380,646 | A | 4/1968 | Doyen et al. | 229/57 |
| 3,389,784 | A | 6/1968 | Hendricks et al. | 206/47 |
| 3,431,706 | A | 3/1969 | Stuck | 53/390 |
| 3,488,022 | A | 1/1970 | Vittori | 248/152 |
| 3,508,372 | A | 4/1970 | Wallerstein et al. | 53/3 |
| 3,512,700 | A | 5/1970 | Evans et al. | 229/53 |
| 3,513,895 | A | 5/1970 | Lattuca | 150/48 |
| 3,552,059 | A | 1/1971 | Moore | 47/41.12 |
| 3,554,434 | A | 1/1971 | Anderson | 229/55 |
| 3,556,389 | A | 1/1971 | Gregoire | 229/53 |
| 3,620,366 | A | 11/1971 | Parkinson | 206/59 C |
| 3,657,840 | A | 4/1972 | Benoist | 47/41 |
| 3,681,105 | A | 8/1972 | Milutin et al. | 117/15 |
| 3,734,280 | A | 5/1973 | Amneus et al. | 206/65 |
| 3,767,104 | A | 10/1973 | Bachman et al. | 229/7 |
| 3,775,903 | A | 12/1973 | Pike | 47/37 |
| 3,869,828 | A | 3/1975 | Matsumoto | 47/84 |
| 3,883,990 | A | 5/1975 | Stidolph | 47/58 |
| 3,910,328 | A | 10/1975 | Marcoux | 150/52 |
| 3,924,354 | A | 12/1975 | Gregoire | 47/34.11 |
| 3,962,503 | A | 6/1976 | Crawford | 428/40 |
| 3,974,960 | A | 8/1976 | Mitchell | 229/62 |
| 4,043,077 | A | 8/1977 | Stonehocker | 47/66 |
| 4,053,049 | A | 10/1977 | Beauvais | 206/318 |
| 4,054,697 | A | 10/1977 | Reed et al. | 428/40 |
| 4,091,925 | A | 5/1978 | Griffo et al. | 206/423 |
| 4,118,890 | A | 10/1978 | Shore | 47/28 |
| 4,124,160 | A | 11/1978 | Meyers et al. | 229/21 |
| 4,170,618 | A | 10/1979 | Adams | 264/101 |
| 4,189,868 | A | 2/1980 | Tymchuck et al. | 47/84 |
| D254,659 | S | 4/1980 | Karotseris | D11/143 |
| 4,216,620 | A | 8/1980 | Weder et al. | 47/72 |
| 4,248,347 | A | 2/1981 | Trimbee | 206/423 |
| 4,250,664 | A | 2/1981 | Remke | 47/76 |
| D259,333 | S | 5/1981 | Charbonneau | D9/306 |
| 4,265,049 | A | 5/1981 | Gorewitz | 47/26 |
| 4,280,314 | A | 7/1981 | Stuck | 53/241 |
| 4,283,032 | A | 8/1981 | Smith | 248/97 |
| 4,297,811 | A | 11/1981 | Weder | 47/72 |
| 4,300,312 | A | 11/1981 | Weder et al. | 47/72 |
| 4,333,267 | A | 6/1982 | Witte | 47/84 |
| 4,338,979 | A | 7/1982 | Dow | 141/10 |
| 4,340,146 | A | 7/1982 | Stratton | 215/100.5 |
| 4,347,686 | A | 9/1982 | Wood | 47/73 |
| 4,380,564 | A | 4/1983 | Cancio et al. | 428/167 |
| 4,396,120 | A | 8/1983 | Morita | 206/460 |
| 4,400,910 | A | 8/1983 | Koudstall et al. | 47/84 |
| 4,413,725 | A | 11/1983 | Bruno et al. | 206/45.33 |
| 4,470,508 | A | 9/1984 | Yen | 206/334 |
| 4,488,697 | A | 12/1984 | Garvey | 248/101 |
| 4,508,223 | A | 4/1985 | Catrambone | 206/423 |
| D279,279 | S | 6/1985 | Wagner | D11/143 |
| 4,608,283 | A | 8/1986 | White | 428/4 |
| 4,621,733 | A | 11/1986 | Harris | 206/423 |
| 4,640,079 | A | 2/1987 | Stuck | 53/390 |
| 4,646,470 | A | 3/1987 | Maggio | 47/76 |
| D292,562 | S | 11/1987 | Weder et al. | D11/164 |
| D292,563 | S | 11/1987 | Weder et al. | D11/164 |
| D293,224 | S | 12/1987 | Weder et al. | D11/164 |
| D293,774 | S | 1/1988 | Weder et al. | D11/164 |
| D293,775 | S | 1/1988 | Weder et al. | D11/164 |
| 4,717,262 | A | 1/1988 | Roen et al. | 383/120 |
| 4,733,521 | A | 3/1988 | Weder et al. | 53/580 |
| 4,741,440 | A | 5/1988 | Harris | 206/423 |
| 4,773,182 | A | 9/1988 | Weder et al. | 47/72 |
| 4,795,601 | A | 1/1989 | Cheng | 264/138 |
| 4,801,014 | A | 1/1989 | Meadows | 206/423 |
| 4,819,803 | A | 4/1989 | Neiser | 206/423 |
| 4,835,834 | A | 6/1989 | Weder | 29/525 |
| D301,991 | S | 7/1989 | Van Sant | D11/149 |
| 4,882,893 | A | 11/1989 | Spencer et al. | 53/449 |
| 4,980,209 | A | 12/1990 | Hill | 428/34.1 |
| 5,018,300 | A | 5/1991 | Chiu et al. | 47/67 |
| 5,073,161 | A | 12/1991 | Weder et al. | 493/154 |
| 5,076,011 | A | 12/1991 | Stehouwer | 47/72 |
| 5,077,937 | A | 1/1992 | Weder et al. | 47/72 |
| 5,085,003 | A | 2/1992 | Garcia | 47/72 |

| | | | | |
|---|---|---|---|---|
| 5,092,465 | A | 3/1992 | Weder et al. | 206/423 |
| 5,105,599 | A | 4/1992 | Weder | 53/399 |
| 5,111,638 | A | 5/1992 | Weder | 53/397 |
| 5,120,382 | A | 6/1992 | Weder | 156/212 |
| 5,148,918 | A | 9/1992 | Weder et al. | 206/423 |
| 5,152,100 | A | 10/1992 | Weder et al. | 47/72 |
| 5,181,364 | A | 1/1993 | Weder | 53/397 |
| 5,195,637 | A | 3/1993 | Weder | 206/423 |
| D335,105 | S | 4/1993 | Ottenwalder et al. | D11/164 |
| 5,199,242 | A | 4/1993 | Weder et al. | 53/397 |
| 5,205,108 | A | 4/1993 | Weder et al. | 53/397 |
| 5,228,234 | A | 7/1993 | de Klerk et al. | 47/41.01 |
| 5,235,782 | A | 8/1993 | Landau | 47/72 |
| 5,239,775 | A | 8/1993 | Landau | 47/72 |
| 5,240,109 | A | 8/1993 | Weder et al. | 206/423 |
| 5,249,407 | A | 10/1993 | Stuck | 53/399 |
| 5,255,784 | A | 10/1993 | Weder et al. | 206/423 |
| 5,259,106 | A | 11/1993 | Weder et al. | 29/469.5 |
| 5,265,727 | A | 11/1993 | Anderson | |
| 5,297,359 | A | 3/1994 | Garcia | 47/58 |
| 5,307,606 | A | 5/1994 | Weder | 53/410 |
| 5,311,992 | A | 5/1994 | Weder et al. | 206/423 |
| 5,315,785 | A | 5/1994 | Avôt et al. | 47/72 |
| 5,332,610 | A | 7/1994 | Weder | 428/99 |
| 5,350,240 | A | 9/1994 | Billman et al. | 383/104 |
| 5,353,575 | A | 10/1994 | Stepanek | 53/461 |
| 5,361,482 | A | 11/1994 | Weder et al. | 29/469 |
| 5,388,695 | A | 2/1995 | Gilbert | 206/423 |
| 5,402,601 | A | 4/1995 | Garcia | 47/72 |
| 5,407,072 | A | 4/1995 | Weder et al. | 206/423 |
| 5,411,137 | A | 5/1995 | Weder et al. | 206/423 |
| 5,428,939 | A | 7/1995 | Weder et al. | 53/397 |
| 5,443,670 | A | 8/1995 | Landau | 156/191 |
| 5,493,809 | A | 2/1996 | Weder et al. | 47/72 |
| D368,025 | S | 3/1996 | Sekerak et al. | D9/305 |
| 5,496,251 | A | 3/1996 | Cheng | 493/224 |
| 5,496,252 | A | 3/1996 | Gilbert | 493/224 |
| 5,526,932 | A | 6/1996 | Weder | 206/423 |
| 5,564,567 | A | 10/1996 | Weder | 206/423 |
| 5,572,849 | A | 11/1996 | Weder et al. | 53/399 |
| 5,572,851 | A | 11/1996 | Weder | 53/399 |
| 5,575,133 | A | 11/1996 | Weder et al. | 53/397 |
| 5,617,703 | A | 4/1997 | Weder | 53/413 |
| 5,624,320 | A | 4/1997 | Martinez | 472/51 |
| 5,634,558 | A | 6/1997 | Weder | 206/423 |
| 5,647,168 | A | 7/1997 | Gilbert | 47/72 |
| 5,836,447 | A | 11/1998 | Garcia et al. | 206/423 |
| 6,131,332 | A | 10/2000 | Garcia | 47/72 |
| 6,321,486 | B1 * | 11/2001 | Weder | 47/72 |

FOREIGN PATENT DOCUMENTS

| | | |
|---|---|---|
| DE | 345464 | 12/1921 |
| DE | 513971 | 11/1930 |
| DE | 1166692 | 3/1964 |
| DE | 2948265 | 4/1966 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 8905250 | 10/1989 |
| DE | 3911847 | 10/1990 |
| EP | 0050990 | 5/1982 |
| EP | 0791543 | 8/1997 |
| FR | 1144102 | 1/1955 |
| FR | 1376047 | 9/1964 |
| FR | 1393725 | 2/1965 |
| FR | 2036163 | 12/1970 |
| FR | 2137325 | 12/1972 |
| FR | 2221936 | 10/1974 |
| FR | 2272914 | 12/1975 |
| FR | 2467796 | 11/1979 |
| FR | 2489126 | 3/1982 |
| FR | 433587 | 7/1985 |
| FR | 2610604 | 8/1988 |
| FR | 2603159 | 3/1989 |
| FR | 2619698 | 3/1989 |
| GB | 5605 | 5/1885 |
| GB | 26878 | 11/1913 |
| GB | 1204647 | 9/1970 |
| GB | 891078 | 5/1975 |
| GB | 28130 | 1/1977 |
| GB | 2056410 | 3/1981 |
| GB | 2074542 | 11/1981 |
| GB | 2128083 | 4/1984 |
| GB | 2252708 | 8/1992 |
| IT | 224507 | 4/1996 |
| JP | 4352664 | 12/1992 |
| JP | 542958 | 2/1993 |
| NL | 8101464 | 9/1945 |
| NL | 8301709 | 12/1984 |
| NL | 1000658 | 1/1996 |
| WO | 9315979 | 8/1993 |

* cited by examiner

PLANT WRAPPER

CROSS-REFERENCE TO RELATED APPLICATIONS

This application is a continuation of U.S. Ser. No. 09/465,613, filed Dec. 17, 1999, now U.S. Pat. No. 6,321,486.

STATEMENT REGARDING FEDERALLY SPONSORED RESEARCH OR DEVELOPMENT

Not Applicable

BACKGROUND

This invention relates generally to flower pot wrappers and methods of their use.

BRIEF DESCRIPTION OF THE INVENTION

A wrapper for a flower pot, comprising a segmented sheet with each segment having a lower portion sized to surround a pot and an upper portion detachable from the lower portion via a detaching element such as perforations. The segmented sheet can be formed about a pot and the adjacent edges of the segments joined and sealed.

DETAILED DESCRIPTION OF THE INVENTION

Figure 1:
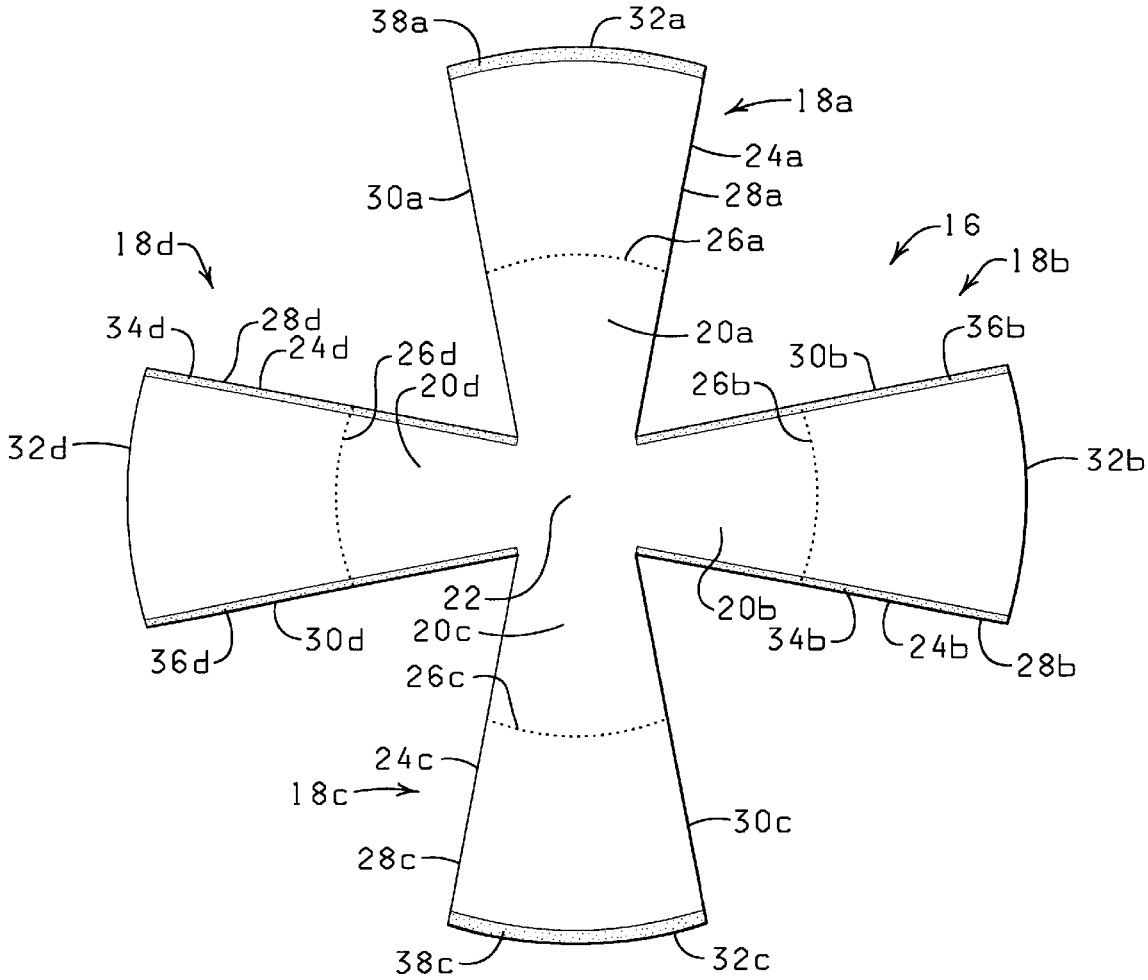
FIG. 1 is a plan view illustrating the wrapper of the present invention prior to placement about a pot.

Referring now more particularly to the drawings, and to those embodiments of the invention here presented by way of illustration, FIG. 1 shows a segmented sheet of material (also referred to herein as segmented sheet) designated by reference numeral 16 to be utilized to cover a pot (designated below as pot 40). As shown herein, it is contemplated that the sheet of material 16 might be substantially circular, and might further include a printed design. Furthermore, the sheet of material 16 will generally be a relatively flexible material, for example preferably a polyethylene film or other polymer film described in more detail below. Moreover, polyethylene is mentioned only by way of example, and it will be readily understood by those skilled in the art that polypropylenes, polyethers, various vinyls and the like can be used equally well. While printability of the material is desirable, it will also be understood that the sheet of material 16 might be solid white and of a translucent nature, or might be colored, either as a solid color or a marbleized, moiree or swirled pattern. In one embodiment, not show herein but similar to that shown in U.S. Pat. No. 5,402,601, the specification of which is hereby incorporated herein by reference in its entirety, both to place the sheet of material 16 and to retain the sheet of material 16, about the pot 40, a frustoconial sleeve (not shown) may be provided and placed about the sheet 16 when disposed about the pot 40. The sleeve when used is sized to receive the pot 40 and retain the sheet of material 16 in place about the pot 40.

While the sheet of material 16 is illustrated as comprising segments having arcuate ends, it will be readily noted that virtually any other shape of material can be used, the primary requirement being to have the sheet of material 16 large enough to cover the pot 40 and to have upper detachable portions extending therefrom to surround a plant disposed in the pot 40.

The sheet of material 16 has a common central base portion 22 which corresponds approximately to the size and shape of the flower pot 40. It should be noted that the central base portion 22 can be any shape such as square, rectangle, polygon or any other shape to conform to the shape of a bottom 42 of the flower pot 40 on which the cover made from the sheet of material 16 is to be used.

The sheet of material 16 shown in FIG. 1 has four segments. The four segments are designated in FIG. 1 by the respective numerals 18*a,* 18*b,* 18*c* and 18*d.* Although the sheet of material 16 is shown herein as comprising four segments, the sheet of material 16 may be made from two, three, five or more separate segments in a manner similar to the four-segmented sheet of material 16 shown herein. Each of the segments 18*a–d* is generally trapezoidal shaped and are joined at the central base portion 22 sized to fit the bottom 42 of the pot 40. Each segment 18*a–d* has a lower portion, 20*a–d,* respectively, and an upper portion 24*a–d,* respectively. Each segment 18*a–d* has a detaching element such as a line of perforations 26*a–d,* respectively, for enabling the detachment of each upper portion 24*a–d* from each lower portion 20*a–d,* respectively. Although each line of perforations 20*a–d* is shown as comprising an arcuate line across each segment 18*a–d,* the present invention contemplates that each line of perforations 20*a–d* (or other detaching elements) may have a different pattern, for example straight, wavy, zig-zag, crenulate, scalloped, sine wave, irregular, or other fanciful or decorative patterns. See for example FIGS. 11–16 of U.S. Ser. No. 08/606,957, the specification of which is hereby incorporated herein by reference. A generally triangularly shaped notch or space is formed between each pair of adjacent segments 18*a–d* so that a side 28*a–d* of each of the segments 18*a–d* is spaced opposite to a side 30*a–d* of each adjacent segment 18*a–d.* For example, side 28*a* is opposite side 30*b,* side 28*b* is opposite side 30*c,* side 28*c* is opposite side 30*d,* and side 28*d* is opposite side 30*a.* Each segment 18*a–d* also has an end 32*a–d,* on each upper portion 24-*a–d,* (also referred to herein as upper ends 32*a–d*) respectively.

Figure 2:
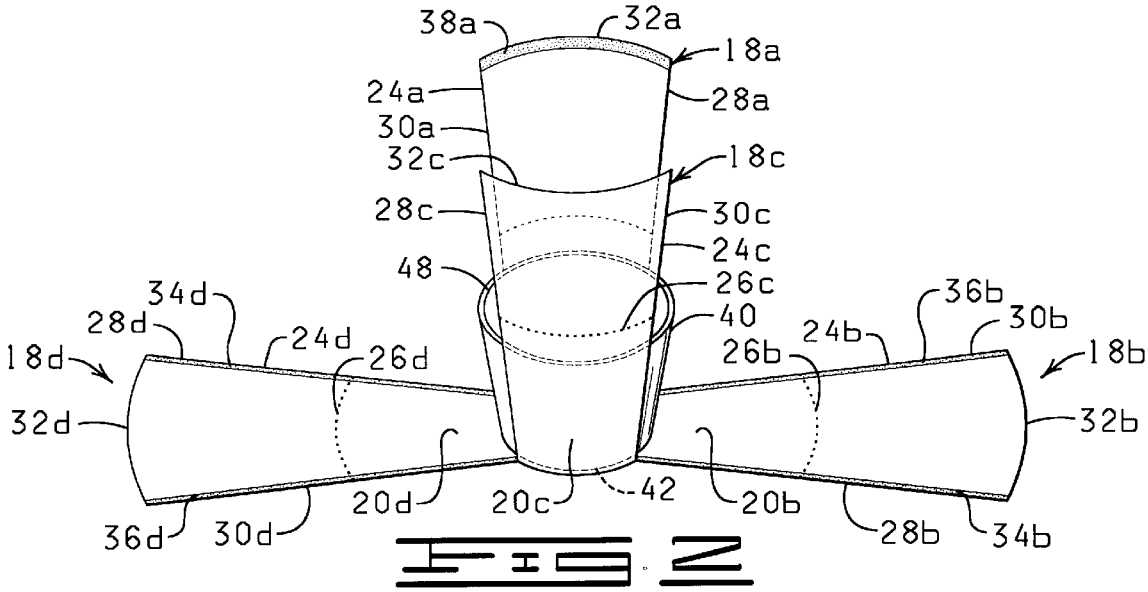
FIG. 2 is a perspective view of the wrapper partially formed about a pot.

In use, the sheet of material 16 is formed about the pot 40 as shown in FIG. 2. The segments 18*a–d* are shaped and sized so that when the segments 18 *a–d* are folded upwardly from the central base portion 22 about the pot 40, a portion of the side 28*a–d* of each of the segments 18*a–d* generally overlaps a portion of the adjacent side 30*b–a,* respectively. When formed about the pot 40, the notches between segments 18*a–d* provide sufficient relief so that the sheet of material 16 will not be appreciably pleated. During the process of forming the sheet of material 16 about the pot 40, the segments 18*a–d* will be urged upwardly and the opposite adjacent sides 28 *a–d* and 30 *a–d* of adjacent segments 18 *a–d* will be slightly overlapped and the entire outer peripheral surface of the pot 40 will be covered by the sheet of material 16 with the central base portion 22 covering the bottom 42 of the flower pot 40, with the portions 20*a–d* covering the pot 40, and the upper portions 24*a–d* each extending upwardly beyond an upper rim 48 of the flower pot 40.

It will therefore be understood by those skilled in the art that a quite different appearance can be achieved on the pot 40 since various papers, heavy plastics, metalized papers, or plastics can be utilized, and even a heavy foil can be utilized, to speed of assembly of the wrapper.

In order to enhance the sealing of sides 28*a–d* to sides 30*b–a,* respectively, a bonding material may optionally be disposed along opposing edges of the segments 18*a–d.* For example as shown in FIG. 1, segment 18*b* has bonding materials 34*b* and 36*b* disposed along sides 28*b* and 30*b,* respectively. Similarly, segment 18*d* has bonding materials 34*d* and 36*d* disposed along sides 28*d* and 30*d,* respectively. These areas of bonding material enhance the connection between opposite and adjacent sides of pairs of segments 18*a–d.*

Figure 3:
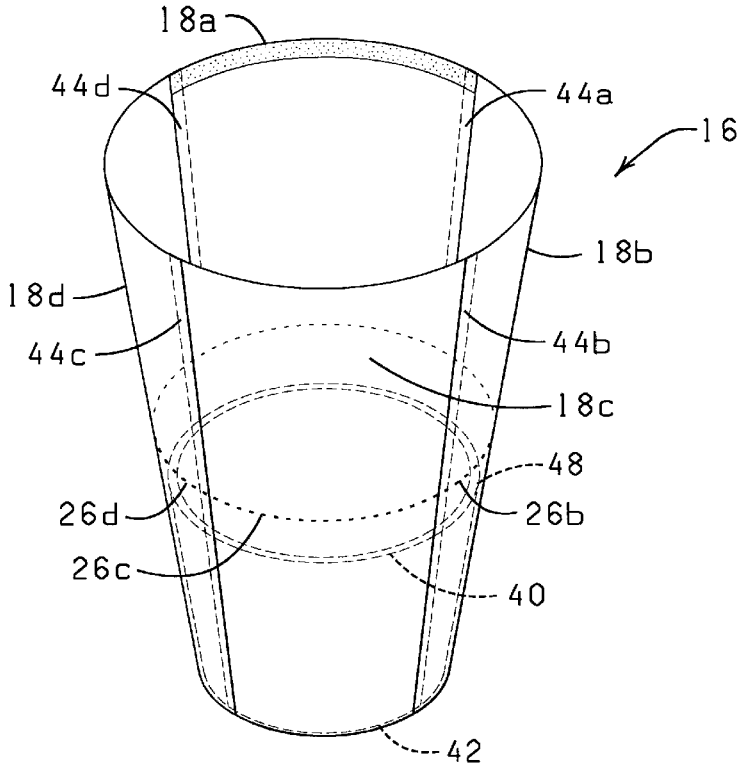
FIG. 3 is a perspective view of the wrapper fully formed about a pot, the segments of the wrapper joined along their sides.

For example, as shown in FIGS. 2 and 3, overlapping sides 28*b* and 30*c* of segments 18*b* and 18*c,* respectively, are sealed along a bonding material 34*b* on segment 18*b* to form a flat joint seal 44*b.* Overlapping sides 28*c* and 30*d* of segments 18*c* and 18*d,* respectively, are sealed along a bonding material 36*d* on segment 18*d* to form a flat joint seal 44*c.* Overlapping sides 28*d* and 30*a* on segments 18*a* and 18*b,* respectively, are sealed along a bonding material 34*d* on segment 18*d* to form a flat joint seal 44*d.* Overlapping sides 28*a* and 30*b* on segments 18*a* and 18*b,* respectively, are sealed along a bonding material 36*b* on segment 18*b* to form a flat joint seal 44*a.*

As noted above bonding materials 34*b* and 34*d* and 36*b* and 36*d* are not required if sealing of the joints 44*a–d* may be accomplished in another manner, for example by heat sealing, sonic sealing or vibratory sealing.

Bonding materials 38*a* and 38*c* are shown as disposed along ends 32*a* and 32*c* respectively, for the purpose of closing the upper ends 32*a–d* of the sheet of material 16 after it has been formed about the pot 40. Bonding materials may also be disposed along ends 32*b* and 32*d.*

The material from which the sheet of material 16 is preferably constructed has a thickness in a range from about 0.1 mil to about 30 mils. Often, the thickness of the sheet of material 16, is in a range from about 0.5 mil to about 10 mils. Preferably, the sheet of material 16 has a thickness in a range from about 1.0 mil to about 5 mils. More preferably, the sheet of material 16 is constructed from a material which is flexible, semi-rigid, rigid, or any combination thereof. The sheet of material 16 may be constructed of a single layer of material or a plurality of layers of the same or different types of materials. Any thickness of the material may be utilized as long as the material functions in accordance with the present invention as described herein. The layers of material comprising the sheet of material 16 may be connected together or laminated or may be separate layers. Such materials used to construct the sheet of material 16 are described in U.S. Pat. No. 5,111,637 entitled "Method For Wrapping a Floral Grouping" issued to Weder et al., on May 12, 1992, which is hereby incorporated herein by reference. Any thickness of material may be utilized in accordance with the present invention as long as the sheet of material 16 may be formed as described herein, and as long as the formed sheet of material 16 may contain at least a portion of a pot or potted plant or a floral grouping and medium, as described herein. Additionally, an insulating material such as bubble film, preferable as one of two or more layers, can be disposed on a portion of the sheet of material 16 in order to provide additional protection for the item, such as the floral grouping, contained therein.

In one embodiment, the sheet of material 16 may be constructed from two polypropylene films. The material comprising the sheet of material 16 may be connected together or laminated or may be separate layers. In alternative embodiment, the sheet of material 16 may be constructed from only one of the polypropylene films.

The sheet of material 16 is constructed from any suitable material that is capable of being formed into a wrapper about a pot and a floral grouping disposed therein. Preferably, the material comprises paper (untreated or treated in any manner), metal foil, polymer film, non-polymer film, fabric (woven or nonwoven or synthetic or natural), cardboard, fiber, cloth, burlap, or laminations or combinations thereof.

The term "polymer film" means a man-made polymer such as a polypropylene or a naturally occurring polymer such as cellophane. A polymer film is relatively strong and not as subject to tearing (substantially non-tearable), as might be the case with paper or foil.

The material comprising the sheet of material 16 may vary in color and may consist of designs or decorative patterns which are printed, etched, and/or embossed thereon using inks or other printing materials. An example of an ink which may be applied to the surface of the material is described in U.S. Pat. No. 5,147,706 entitled "Water Based Ink On Foil And/Or Synthetic Organic Polymer" issued to Kingman on Sep. 15, 1992 and which is hereby incorporated herein by reference.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. Each of the above-named characteristics may occur alone or in combination and may be applied to the upper and/or lower surface of the material comprising the sheet of material 16. Moreover, portions of the material used in constructing the sheet of material 16 may vary in the combination of such characteristics. The material utilized for the sheet of material 16 itself may be opaque, translucent, transparent, or partially clear or tinted transparent.

It will generally be desired to use the sheet of material 16 as a covering for the pot 40 having a plant disposed therein. The pot 40 preferably contains a plant. The term "pot" as used herein refers to any type of container used for holding a floral grouping or plant. Examples of pots, used in accordance with the present invention include, but not by way of limitation, clay pots, wooden pots, plastic pots, pots made from natural and/or synthetic fibers, or any combination thereof. The pot 40 is adapted to receive a floral grouping in the retaining space thereof. The floral grouping may be disposed within the pot 40 along with a suitable growing medium described in further detail below, or other retaining medium, such as a floral foam. It will also be understood that the floral grouping and any appropriate growing medium or other retaining medium, may be disposed in the sheet of material 16 without a pot.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping generally comprises a bloom or foliage portion and a stem portion. Further, the floral grouping may comprise a growing potted plant having a root portion (not shown) as well. However, it will be appreciated that the floral grouping may consist of only a single bloom or only foliage, or a botanical item (not shown), or a propagule (not shown). The term "floral grouping" may be used interchangeably herein with both the terms "floral arrangement" and "potted plant". The term "floral grouping" may also be used interchangeably herein with the terms "botanical item" and/or "propagule."

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

In accordance with the present invention, a bonding material may be disposed on a portion of the sheet of material 16 to assist in holding the sheet of material 16 to the pot 40 having the floral grouping. Further, the term "detaching element" as used generally herein, means any element or combination of elements, or features, such as, perforations, tear strips, zippers, and any other devices or elements of this nature known in the art, or any combination thereof, which enable the tearing away or detachment of one object from another. Therefore, while perforations are shown and described in detail herein, it will be understood that tear strips, zippers, or any other "detaching elements" known in the art, or any combination thereof, could be substituted therefore and/or used therewith. Other examples of perforation patterns which may be used herein are shown in FIGS. 26–31 in U.S. Pat. No. 5,493,809, the specification of which is incorporated herein by reference in its entirety.

In one embodiment, the lower portion 20*a–d* of each segment 18*a–d* of the sheet of material 16 further comprises a skirt portion which extends above the pot 40 after the upper portions 24*a–d* of the segments 18*a–d* are detached.

It will therefore be seen from the above that the present invention provides a very quick and easy flower pot cover/wrap system that can be used with inexpensive sheets of materials for decoration. The sheet of material can be printed with various designs, or be a solid color, and can even be transparent if such an effect is desired. As noted above, through the use of an outer floral sleeve, installation of the sheet of material 16 will be very quick, taking only a few seconds for complete covering of the pot 40 without forming joint seals.

The sheet of material 16 may be formed about the pot 40 by a user's hands, or by using a forming apparatus as shown in U.S. Pat. No. 5,402,601 cited above. For example, a sheet of material 16 may be positioned generally above a female mold having a mold opening in a position wherein the central base portion 22 of the sheet of material 16 is positioned generally over the female mold opening and the segments 18*a–d* each extend outwardly therefrom. A male mold is connected to a cylinder rod of a hydraulic cylinder. The male mold is shaped to be matingly disposed in the female mold.

In operation, the hydraulic cylinder is actuated to moved the male die in the downward direction to a position wherein the lower end of the male die engages the central base portion 22 of the sheet of material 16. The male die further is moved in the downward direction pushing the central base portion 22 and the segments 18*a–d* connected thereto into the female mold. As the sheet of material 16 is pushed into the female mold the segments are formed in an upward direction extending generally upwardly from the central base portion 22. As mentioned before, the segments 18*a–d* are shaped so that when the segments have been moved in the upward direction and the male mold is matingly disposed in the female mold, a portion of a side of each of the segments 18*a–d* overlaps an adjacent portion of a side of the adjacent segment 18*a–d*. The sides of each of the segments 18*a–d* are connected to form the decorative cover as shown above. The overlapping sides 28*a–d* and 30*b–a*, respectively, may be sealingly connected by heat sealing (without a bonding material) when the cover is formed from a heat sealable material such as polypropylene for example. In other instances, it may be necessary as shown above to connect the overlapping sides by adhesively or cohesively connecting the overlapping portion of the sides of each of the segments 18*a–d*.

Figure 4:
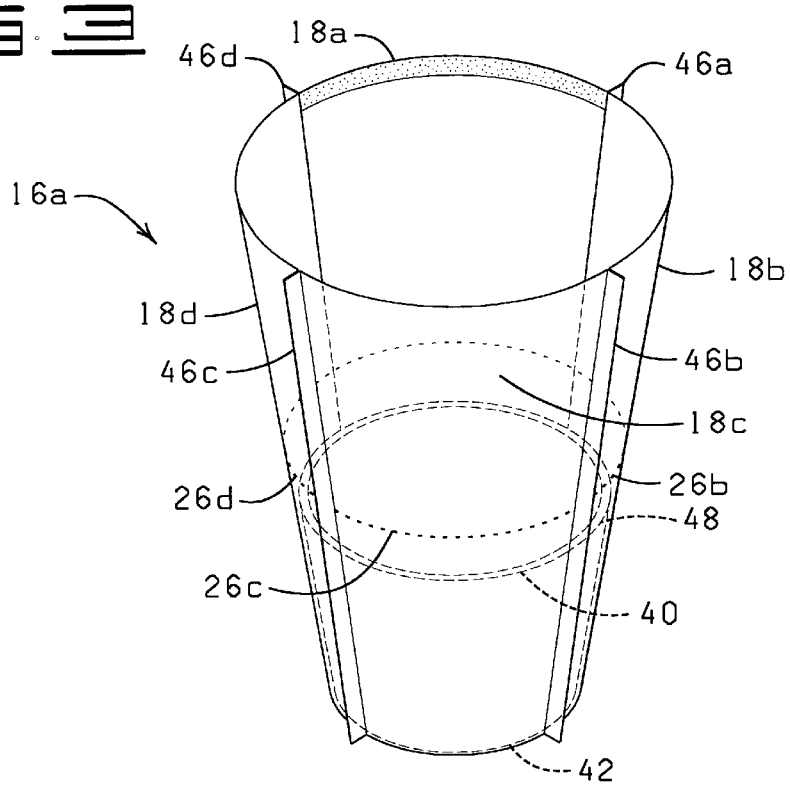
FIG. 4 is a perspective view showing the wrapper having fin joints along the segments of the wrapper.

Shown in FIG. 4 is an alternate type of seal, a fin joint seal 46*a–d* which may be formed rather that the flat joint seal 44*a–d*, either manually, or using an apparatus such as a pair of dies in a manner known to those of ordinary skill in the art, for example as shown in U.S. Pat. No. 5,523,046 incorporated herein by reference.

Changes may be made in the construction and the operation of the various components, elements and assemblies described herein or in the steps or the sequence of steps of the methods described herein without departing from the spirit and scope of the invention as defined in the following claims.

What is claimed is:

1. A segmented sheet for use as a flower pot wrapper, comprising:

at least two segments having a common central base portion, each segment extending away from the central base portion and having a lower portion and an upper portion, the upper portion removable from the lower portion via a detaching element positioned between the lower portion and the upper portion, each segment having a first side, a second side and an outer end, and the segments sized such that when the segmented sheet is placed about a pot having a bottom end, the bottom end of the pot rests against the central base portion of the segmented sheet and the segments can be formed upwardly adjacent the pot wherein overlapping portions of adjacent segments can engage each other such that the pot is entirely covered by the lower portions of the segments of the segmented sheet, and the upper portions of the segments extend a distance upwardly above the pot.

2. The segmented sheet of claim 1 wherein the detaching element comprises a line of perforations.

3. The segmented sheet of claim 1 further comprising a bonding material disposed upon a portion thereof for bondingly sealing overlapping portions of the segments.

4. The segmented sheet of claim 1 further comprising a bonding material disposed upon an end portion of at least one of the segments for bondingly connecting upper ends of the segments after the segmented sheet is wrapped about the pot.

5. The segmented sheet of claim 2 wherein the line of perforations is arcuate, wavy, irregular, sinusoidal, toothed, zig-zagged, or otherwise non-linear, or straight.

6. The segmented sheet of claim 1 where the number of segments is two to six.

7. The segmented sheet of claim 1 wherein the number of segments is four.

8. A method of wrapping a flower pot comprising:

providing a segmented sheet having at least two segments having a common central base portion, each segment extending away from the central base portion and having a lower portion and an upper portion, the upper portion removable from the lower portion via a detaching element positioned between the lower portion and the upper portion, each segment having a first side, a second side and an outer end; and forming the segments of the segmented sheet about the pot and forming engaged overlapping portions of adjacent segments wherein the pot is entirely covered by the lower portions of the segments and wherein the upper portions of the segments extend a distance above the upper end of the pot.

9. The method of claim 8 wherein a seal is formed in each overlapping portion of each adjacent segment.

10. The method of claim 9 wherein the seal is formed by joining overlapping portions of adjacent segments via a bonding material disposed upon portions of the adjacent segments.

11. The method of claim 9 wherein the seal between the adjacent segments is formed by heat sealing.

12. The method of claim 9 wherein the seal is a flat overlapping seal.

13. The method of claim 9 wherein the seal in a fin seal.

14. The method of claim 8 wherein the detaching element comprises a line of perforations.

15. The method of claim 14 wherein the line of perforations is arcuate, wavy, irregular, sinusoidal, toothed, zig-zagged, or otherwise non-linear, or straight.

16. The method of claim 8 wherein the segmented sheet comprises two to six segments.

17. The method of claim 8 wherein the segmented sheet comprises four segments.

18. The method of claim 8 wherein the segments of the segmented sheet are manually formed about the pot.

19. The method of claim 9 wherein the segments of the segmented sheet are automatically formed about the pot.

20. A cover formed by the method comprising:

providing a segmented sheet having at least two segments having a common central base portion, each segment extending away from the central base portion and having a lower portion and an upper portion, the upper portion removable from the lower portion via a detaching element positioned between the lower portion and the upper portion, each segment having a first side, a second side and an outer end; and forming the segments of the segmented sheet about a mold wherein a portion of each segment overlaps and joins a portion of the adjacent segment to form a seal between the adjacent segments and wherein the joined portions of the segments form a cover sized to contain a pot and wherein the upper portions of the segments form a detachable sleeve sized to substantially enclose a plant disposed within the pot.

21. The cover of claim 20 wherein the portions of the adjacent segments are joined by a bonding material disposed on a portion of the segmented sheet.

22. The cover of claim 20 wherein the seal between the adjacent segments is formed by heat sealing.

23. The cover of claim 20 wherein the seal is a flat overlapping seal.

24. The cover of claim 20 wherein the seal in a fin seal.

25. The cover of claim 20 wherein the detaching element comprises a line of perforations.

26. The cover of claim 25 wherein the line of perforations is arcuate, wavy, irregular, sinusoidal, toothed, zig-zagged, or otherwise non-linear, or straight.

27. The cover of claim 20 wherein the segmented sheet comprises two to six segments.

28. The cover of claim 20 wherein the segmented sheet comprises four segments.

29. The cover of claim 20 wherein the segments of the segmented sheet are manually formed about the pot.

30. The cover of claim 20 wherein the segments of the segmented sheet are automatically formed about the pot.

31. The cover of claim 20 wherein the cover formed from the joined portions further comprises a skirt portion.

32. The cover of claim 20 wherein the seal is formed only in portions of the lower portions of the adjacent segments.

* * * * *